US006644418B2

(12) United States Patent
Haga

(10) Patent No.: US 6,644,418 B2
(45) Date of Patent: Nov. 11, 2003

(54) HAMMER DRILL

(75) Inventor: Hiroshi Haga, Hitachinaka (JP)

(73) Assignee: Hitachi Koki Co., Ltd. (JP)

( * ) Notice: Subject to any disclaimer, the term of this patent is extended or adjusted under 35 U.S.C. 154(b) by 0 days.

(21) Appl. No.: 10/285,591

(22) Filed: Nov. 1, 2002

(65) Prior Publication Data

US 2003/0094292 A1 May 22, 2003

(30) Foreign Application Priority Data

Nov. 16, 2001 (JP) ..... 2001-352274
Sep. 13, 2002 (JP) ..... 2002-268153

(51) Int. Cl.[7] ..... B25D 11/04
(52) U.S. Cl. ..... 173/48; 173/109; 173/201
(58) Field of Search ..... 173/109, 48, 201, 173/212, 122, 133

(56) References Cited

U.S. PATENT DOCUMENTS 5,975,217 A * 11/1999 Frenzel et al. ..... 173/201
6,035,945 A * 3/2000 Ichijyou et al. ..... 173/48
6,116,352 A * 9/2000 Frauhammer et al. ..... 173/109
6,227,309 B1 * 5/2001 Henke et al. ..... 173/201
6,431,290 B1 * 8/2002 Muhr et al. ..... 173/201

FOREIGN PATENT DOCUMENTS

JP 9136273 5/1997

* cited by examiner

*Primary Examiner*—Scott A. Smith
(74) *Attorney, Agent, or Firm*—Parkhurst & Wendel, L.L.P.

(57) ABSTRACT

An engaging portion, formed at an axial end of an intermediate member, is engageable with a slide sleeve. A cylinder has an elongated hole with an axial length longer than a shifting distance of the intermediate member. The slide sleeve includes an annular member and a slide member. The annular member has an inner cylindrical wall engageable with the engaging portion of the intermediate member and a projection extending in a radially outward direction passing through the elongated hole beyond an outer surface of the cylinder. The slide member is coupled around the outer surface of the cylinder and is slidable in the axial direction of the cylinder. One axial end of the slide member, positioned closer to a working tool, is engaged with the projection of the annular member. The other axial end of the slide member is urged toward the working tool by an urging member.

4 Claims, 3 Drawing Sheets

HAMMER DRILL

BACKGROUND OF THE INVENTION

The present invention relates to a hammer drill and more particularly to a mechanism for preventing a striking member of the hammer drill from continuing the non-load striking motion.

A conventional hammer drill includes a striking force transmitting mechanism and a rotational motion transmitting mechanism. The striking force transmitting mechanism converts a rotational motion of a motor into a reciprocative motion of a piston slidably accommodated in a cylinder. A striking member is positioned in the cylinder and is axially offset from the piston via an air chamber. The striking member slides in the cylinder in response to the reciprocative movement of the piston. An intermediate member abuts a working tool detachably held in a tool holder. The striking member strikes the intermediate member. The rotational motion transmitting mechanism transmits the rotational motion of the motor to the working tool via the cylinder and the tool holder. The intermediate member has a large-diameter portion positioned close to the working tool and a small-diameter portion positioned close to the striking member. A rubber or cushion member is provided between the large-diameter portion of the intermediate member and the striking member to absorb the shock to be transmitted from the intermediate member to the piston.

The Japanese Patent Application Laid-Open No. 9-136273 discloses this kind of conventional hammer drill. According to this conventional hammer drill, the cylinder has ventilation holes allowing the air chamber to communicate with the outside of the cylinder. A slide sleeve controls the opening and closing of the ventilation holes of the cylinder in response to a shifting movement of the intermediate member. More specifically, the slide sleeve closes the ventilation holes of the cylinder when the working tool is depressed or pushed against an opponent member to be drilled to enable the hammer drill to perform a striking operation. On the other hand, the slide sleeve opens the ventilation holes of the cylinder when the working tool is not depressed or pushed against the opponent member to bring the hammer drill into an idle or inoperable condition. This is generally referred to as a non-load continuous striking operation preventing mechanism.

The non-load continuous striking operation preventing mechanism includes a slide sleeve which is provided on an outer cylindrical surface of the cylinder and is slidable in the axial direction of the cylinder. A resilient member always urges the slide sleeve toward the working tool. An axial end of the slide sleeve is positioned on an outer surface of the small-diameter portion of the intermediate member. A washer and a damper serving as a cushion member are disposed between a stepped portion of the intermediate member and the axial end of the slide sleeve.

When the working tool is depressed or pushed against the opponent member, the intermediate member shifts toward the striking member relative to the tool holder. The shifting movement of the intermediate member is transmitted via the washer and the damper to the slide sleeve. Thus, the slide sleeve shifts in the axial direction against the urging force of the resilient member. The slide sleeve closes the ventilation holes to enable the hammer drill to perform a striking operation.

After finishing the striking operation, the working tool is released from the depression force having been applied thereon. The intermediate member and the working tool return their home positions by the urging force of the resilient member which is transmitted via the slide sleeve, the washer and the damper to the intermediate member. Thus, the ventilation holes of the cylinder are opened to bring the hammer drill into an idle or inoperable condition.

Furthermore, according to the conventional hammer drill, the tool holder has a slit. The axial end of the slide sleeve, located inside the cylinder, is positioned on an outer surface of the small-diameter portion of the intermediate member. The washer and the damper are disposed between the stepped portion of the intermediate member and the axial end of the slide sleeve. The shock, if caused during a striking operation, is absorbed by the damper before the shock is transmitted from the intermediate member to the striking member, as the slide sleeve is brought into contact with the axial end of the cylinder.

According to the above-described conventional mechanism, one end of the intermediate member is supported by an inner surface of the tool holder having substantially the same radius with that of the large-diameter portion of the intermediate member. On the other hand, the damper and a part of the slide sleeve cooperatively support an axial mid point of the intermediate member. The mid point of the intermediate member is relatively far from the striking member. In other words, there is a significant offset between the closest support point of the intermediate member and the striking member in the axial direction.

The presence of this kind of offset gives adverse influence to the behavior of the reciprocative motion of the intermediate member which is driven by the striking member. More specifically, the intermediate member fluctuates in the radial direction and, as a result, the intermediate member inclines with respect to the axis of the cylinder. The striking force disperses toward circumferential portions of the intermediate member. The striking force transmitting performance deteriorates. The life of the intermediate member and the circumferential peripheral portions will be shortened. The striking force dispersing toward the circumferential portions of the intermediate member will cause vibration in the main body of the hammer drill.

Both of the damper and the slide sleeve need not reciprocate together with the intermediate member. Hence, for the purpose of suppressing a frictional loss, a significant clearance is provided between the outer surface of the intermediate member and the inner surface of the damper or the slide sleeve. Providing such a clearance tends to enlarge the fluctuation of the intermediate member. The inclination of the intermediate member will increase.

SUMMARY OF THE INVENTION

In view of the problems of the above-described prior art, the present invention has an object to provide a reliable mechanism for preventing the non-load continuous striking operation of a hammer drill which is capable of suppressing vibration and assuring a long-lasting life.

In order to accomplish this and other related objects, the present invention provides a hammer drill including a crank shaft driven by a motor, a piston engaged with the crank shaft and slidably accommodated in a cylinder to reciprocate in an axial direction of the cylinder. A striking member, axially offset from the piston via an air chamber and slidably accommodated in the cylinder, reciprocates in the axial direction of the cylinder so that a reciprocative motion of the piston is transmitted via the air chamber to the striking member. A tool holder, disposed coaxially with the cylinder, detachably holds a working tool. An intermediate member, slidably accommodated in the tool holder or in the cylinder, reciprocates in the axial direction of the cylinder in response to a reciprocative motion of the striking member to strike the working tool. A rotational motion transmitting mechanism is provided for transmitting a rotational motion of the motor to the working tool. The cylinder has a ventilation hole for allowing the air chamber to communicate with the outside of the cylinder. A slide sleeve is slidable in the axial direction of the cylinder and always urges the intermediate member in a direction opposed to the piston, so that the slide sleeve closes the ventilation hole when the intermediate member is positioned close to the piston while the slide sleeve opens the ventilation hole when the intermediate member is positioned far from the piston. An engaging portion is formed at an axial end of the intermediate member and is engageable with the slide sleeve. The cylinder has an elongated hole with an axial length longer than a shifting distance of the intermediate member. The slide sleeve includes an annular member and a slide member. The annular member has an inner cylindrical wall engageable with the engaging portion of the intermediate member and a projection extending in a radially outward direction passing through the elongated hole beyond an outer surface of the cylinder. And, the slide member is coupled around the outer surface of the cylinder and is slidable in the axial direction of the cylinder. One axial end of the slide member, positioned closer to the working tool, is engaged with the projection of the annular member. And, the other axial end of the slide member is urged toward the working tool by an urging member.

Preferably, the intermediate member includes a large-diameter portion which is positioned close to the working tool and a small-diameter portion which is positioned close to the striking member. A damper, disposed between the large-diameter portion of the intermediate member and the striking member, absorbs an impact force to be transmitted from the intermediate member to the striking member. And, the damper is interposed between a step formed on an inner wall of the tool holder and an axial end of the cylinder.

Preferably, a seal member is provided on an outer surface of the large-diameter portion of the intermediate member so as to be brought into contact with an inner wall of the tool holder.

Preferably, an annular cushion is provided between the engaging portion of the intermediate member and the slide sleeve.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1A:
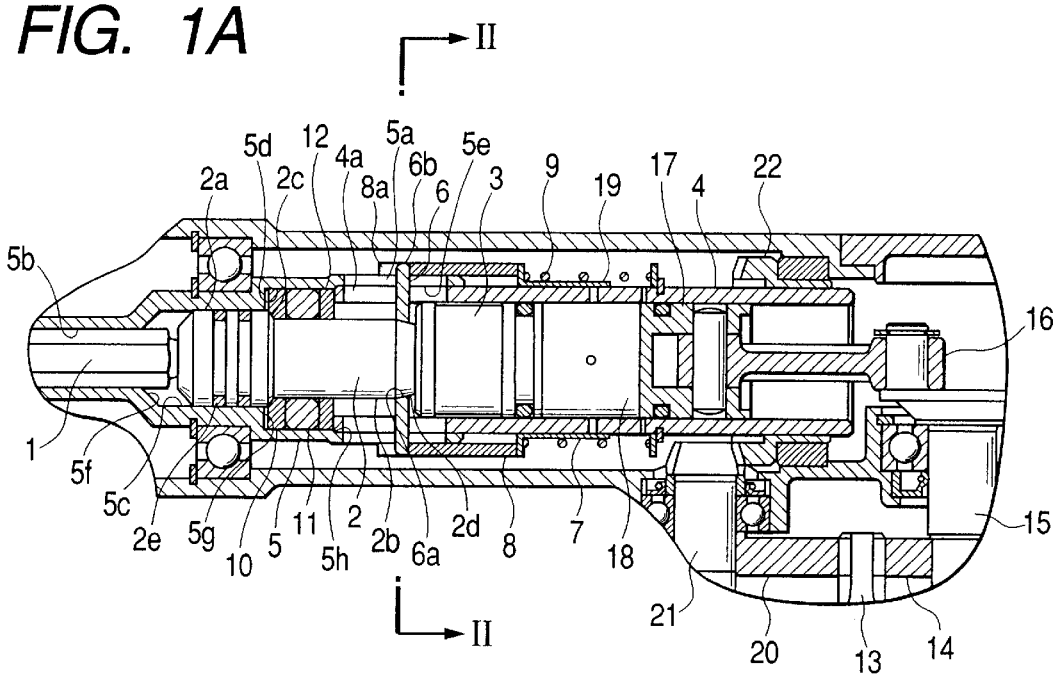
FIG. 1A is a vertical cross-sectional view showing a hammer drill in accordance with a preferred embodiment of the present invention.

Preferred embodiments of the present invention will be explained with reference to attached drawings. Identical parts are denoted by the same reference numerals throughout the views.

FIGS. 1A to 3 show a hammer drill in accordance with a preferred embodiment of the present invention.

As shown in the drawings, the hammer drill of this embodiment includes a motor (not shown) equipped with a pinion 13. The pinion 13 serves as an output shaft of the motor. A first gear 14 meshes with the pinion 13 to transmit the rotational motion of the motor to a crank shaft 15. The crank shaft 15 thus rotates in response to the rotation of the motor. A connecting rod 16 has one end engaged with the crank shaft 15. The other end of the connecting rod 16 is connected to a piston 17 which is slidably accommodated in a cylinder 4. The piton 17 reciprocates in the axial direction of the cylinder 4. In this manner, the rotational motion of the motor is converted into the reciprocative motion of the piston 17.

A striking member 3, slidably accommodated in the cylinder 4, is axially offset from the piston 17 via an air chamber 18. The reciprocative motion of the piston 17 is transmitted to the striking member 3 via the air chamber 18. The striking member 3 reciprocates in the axial direction of the cylinder 4. A tool holder 5, disposed coaxially with the cylinder 4, detachably holds a working tool 1 attached to a front or distal end of the hammer drill.

The reciprocative motion of the striking member 3 is transmitted to an intermediate member 2 which is accommodated in the cylinder 4 and the tool holder 5 and is slidably in the axial direction of the cylinder 4. The intermediate member 2 strikes the working tool 1 in response to the reciprocative movement of the striking member 3.

A damper 11, interposed between the intermediate member 2 and the striking member 3, absorbs or suppresses the impact force or shock to be transmitted from the intermediate member 2 to the striking member 3. A rotational motion transmitting mechanism, provided for transmitting the rotational motion of the motor to the working tool 1, rotates in response to the rotational motion of the motor and drives (i.e., rotates) the working tool 1 about its axis.

The cylinder 4 has ventilation or breath holes 19 for allowing the air chamber 18 to communicate with the outside of the cylinder 4.

A slide sleeve, constituted by a plurality of members 6, 7 and 8, is slidable in the axial direction of the cylinder 4 and always urges the intermediate member 2 in the direction opposed to the piston 17. The slide sleeve closes the ventilation holes 19 when the intermediate member 2 is positioned close to the piston 17. The slide sleeve opens the ventilation holes 19 when the intermediate member 2 is positioned far from the piston 17.

The rotational motion transmitting mechanism includes a second gear 20 meshing with the pinion 13 of the motor, a first bevel gear 21 engaged with the second gear 20 so as to be integrally rotatable with the second gear 20, and a second bevel gear 22 fixed to the outside of the cylinder 4 and meshing with the first bevel gear 21 so as to be integrally rotatable with the first bevel gear 21. Thus, the rotational force of the motor is transmitted to the cylinder 4 via the second gear 20, the first bevel gear 21, and the second bevel gear 22.

As shown in the drawings, the tool holder 5 is coupled around the outer cylindrical surface of the cylinder 4. The tool holder 5, disposed coaxially with the cylinder 4, is fixed with the cylinder 4 by means of pins (not shown) or comparable connecting members. The tool holder 5 has a tool holding bore 5*b* configured into a hexagonal shape fitting to the working tool 1. The tool holding bore 5*b* prevents the working tool 1 from causing a rotation relative to the tool holder 5. Thus, the rotational force of the motor is transmitted to the working tool 1 via the cylinder 4 and the tool holder 5. The working tool 1 rotates in response to the rotation of the motor. The mechanism for restricting the rotation of the working tool 1 in the tool holder 5 can be variously modified. When the working tool 1 has another polygonal shape, it is desirable to configure the tool holding bore 5*b* into a similar polygonal shape. When the working tool 1 has a groove, it is preferable to form an engaging portion mating with this groove.

Figure 1B:
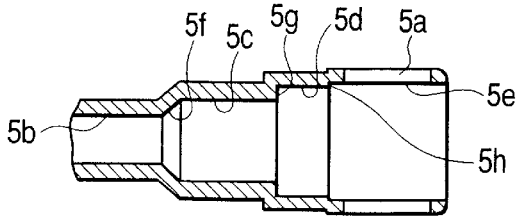
FIG. 1B is a vertical cross-sectional view showing a tool holder constituting the hammer drill shown in FIG. 1A.

As described above, to transmit the rotation of the cylinder 4 to the working tool 1, the tool holder 5 is securely fixed to the cylinder 4 at one end and is engage with the working tool 1 with an anti-rotational relationship between them. In addition to the tool holding bore 5*b* for securely and non-rotationally holding the working tool 1, as shown in the drawings, the tool holder 5 has an intermediate member holding bore 5*c*, a damper holding bore 5*d*, and a cylinder engaging bore 5*e*. The intermediate member holding bore 5*c*, having an inner diameter substantially identical with that of a large-diameter portion 2*a* of the intermediate member 2, accommodates the intermediate member 2 and allows the intermediate member 2 to slide in the axial direction of the tool holder 5. The damper holding bore 5*d* accommodates the damper 11 together with two washers 10 and 12 disposed axially next to this damper 11 at both sides thereof. The cylinder engaging bore 5*e* engages with an outer cylindrical portion of the cylinder 4. The inner diameters of these members are different from each other, and become large successively in the order of the tool holding bore 5*b*, the intermediate member holding bore 5*c*, the damper holding bore 5*d*, and the cylinder engaging bore 5*e*, as shown in FIG. 1B.

A step 5*f* formed in an inner wall of the tool holder 5 is a tapered or inclined annular surface connecting the tool holding bore 5*b* and the intermediate member holding bore 5*c*. The step 5*f* can be brought into contact with a front or distal end of the intermediate member 2. The step 5*f* serves as a stopper for restricting the forward movement (i.e., the movement toward the working tool 1) of the intermediate member 2.

A step 5*g* formed in the inner wall of the tool holder 5 is a perpendicular surface connecting the intermediate member holding bore 5*c* and the damper holding bore 5*d*. The damper 11 and the washers 10 and 12 are sandwiched between the step 5*g* and a front end of the cylinder 4.

A step 5*h* formed in the inner wall of the tool holder 5 is a perpendicular surface connecting the damper holding bore 5*d* and the cylinder engaging bore 5*e*. The step 5*h* abuts the front or distal end of the cylinder 4 so as to accurately position the tool holder 5 with respect to the cylinder 4 when they are assembled with each other. However, if the accurateness in assembling the cylinder 4 and the tool holder 5 is not so severely required, it will be possible to omit the step 5*h*. In this case, the inner diameter of the damper holding bore 5*d* is equalized with the inner diameter of the cylinder engaging bore 5*e*.

As described above, the damper 11 suppresses or absorbs the impact force acting from the intermediate member 2 to the piston 17 during a striking operation of the hammer drill. The damper 11 is interposed or sandwiched between the step 5*g* in the tool holder 5 and the front or distal end of the cylinder 4. The washer 12 is always brought into contact with the front or distal end of the cylinder 4. The intermediate member 2 shifts toward the striking member 3 due to a reaction force caused when the intermediate member 2 strikes the working tool 1. When a step 2*c* of the intermediate member 2, formed into a tapered or inclined annular surface, is brought into contact with the washer 10, the impact force acting on the intermediate member 2 is absorbed by the damper 11. Accordingly, the damper 11 and washers 10 and 12 cooperatively restrict the shifting movement of the intermediate member 2 toward the striking member 3.

As shown in the drawing, the tool holder 5 has two elongated holes 5*a* which are elongated in the axial direction of the cylindrical tool holder 5 and are symmetrically arranged with respect to the axis of the cylindrical tool holder 5. The cylinder 4 has two elongated holes 4*a* communicating with the elongated holes 5*a* of the tool holder 5.

The intermediate member 2, slidably supported in the tool holder 5 to cause a reciprocative motion, has an engaging portion 2*d* at its proximal or rear end close to the striking member 3. The engaging portion 2*d* has an inclined or tapered surface. The radius of the inclined engaging portion 2*d* (i.e., a radius of a cross section of the engaging portion 2*d*) taken along a plane normal to the axis of the intermediate member 2 gradually decreases with axially approaching position toward the striking member 3.

Figure 1C:
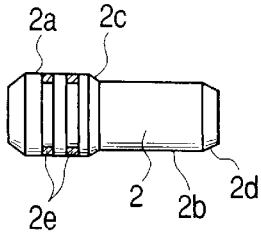
FIG. 1C is a side view showing an intermediate member constituting the hammer drill shown in FIG. 1A.
Figure 3:
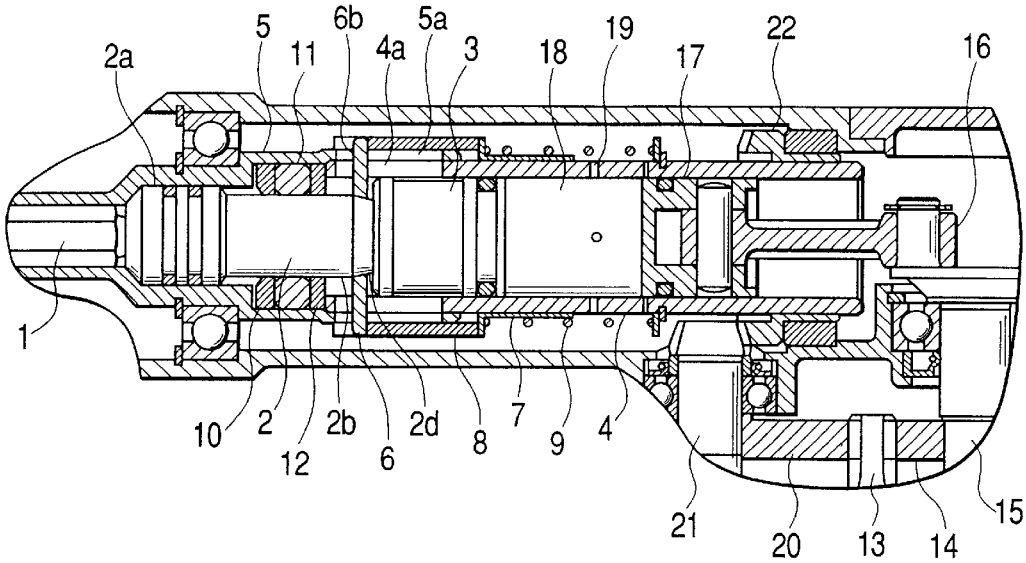
FIG. 3 is a vertical cross-sectional view showing an operated condition of the hammer drill in accordance with the preferred embodiment of the present invention.

Annular seal members 2*e* are provided on an outer cylindrical surface of the large-diameter portion 2*a* of the intermediate member 2 so as to be brought into contact with an inner wall of the tool holder 5, as shown in FIG. 1C.

An annular member 6, positioned around the outer circumferential surface of the intermediate member 2 at the axially rear or proximal end closer to the striking member 3, has an inner cylindrical wall 6*a* configured into an inclined or tapered shape engageable with the inclined engaging portion 2*d* of the intermediate member 2.

Figure 2:
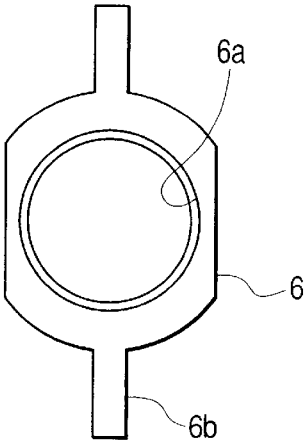
FIG. 2 is a front view showing engagement of an annular member and the intermediate member of the hammer drill, taken along a line II—II shown in FIG. 1A.

The annular member 6, as shown in FIG. 2, has two projections 6*b* extending symmetrically in the radially outward direction (i.e., in the up-and-down direction in FIG. 2). Each outwardly extending projection 6*b* of the annular member 6 is positioned in the corresponding elongated holes 5*a* and 4*a* of the tool holder 5 and the cylinder 4, when assembled with the tool holder 5 and the cylinder 4. The annular member 6 is shiftable in the longitudinal direction of the elongated holes 5*a* and 4*a*, i.e., shiftable in the axial direction of the cylinder 4.

The projection 6*b* of the annular member 6 extends in the radially outward direction passing through the elongated holes 5*a* and 4*a* and beyond the outer cylindrical surfaces of the cylinder 4 and the tool holder 5. The radially outermost end of each projection 6*b* engages with a groove 8*a* of a second sleeve 8. The second sleeve 8 is coupled around the outer cylindrical surface of the tool holder 5 and is shiftable in the axial direction of the cylinder 4. The groove 8*a* extends in the axial direction from the front or distal end of the second sleeve 8. The other end (i.e., rear of proximal end) of second sleeve 8 abuts a front or distal end of a first sleeve 7. The first sleeve 7 is coupled around the outer cylindrical surface of the cylinder 4 and is shiftable in the axial direction of the cylinder 4. The front or distal end of the first sleeve 7 is configured into a flange shape protruding in the radial direction for supporting one end of a coil spring 9 located around the cylinder 4. The coil spring 9 serves as an urging member for always pressing the first sleeve 7 toward the working tool 1.

The resilient force of the coil spring 9 is transmitted via the first sleeve 7, the second sleeve 8, and the annular member 6 to the inclined engaging portion 2*d* of the intermediate member 2 which strikes the working tool 1. Namely, the first sleeve 7, the second sleeve 8, and the annular member 6 are integrated as a unit (i.e., the slide sleeve) resiliently urged toward the direction opposed to the piston 17.

As described above, all of the members 6, 7 and 8 cooperatively constituting the slide sleeve are always urged toward the working tool 1 by the coil spring 9. The inner cylindrical wall 6*a* of the annular member 6 is brought into contact with the inclined engaging portion 2*d* of the intermediate member 2. Thus, the intermediate member 2 is always urged toward the working tool 1. The axial length of the elongated hole 4*a* of the cylinder 4 and the axial length of the elongated hole 5*a* of tool holder 5 are longer than a shifting distance of the intermediate member 2. Accordingly, the slide sleeve (i.e., the members 7, 8 and 6) always shifts in the axial direction of the cylinder 4 in accordance with the reciprocative motion of the intermediate member 2.

The intermediate member 2 is brought into contact with the rear or proximal end of the working tool 1 held in the tool holder 5. When a user depresses or pushes the working tool 1 against an opponent member to be drilled for a striking operation, the working tool 1 shifts toward the striking member 3 relative to the tool holder 5. In response to the shifting movement of the working member 1, the intermediate member 2 shifts toward the striking member 3 relative to the tool holder 5. The slide sleeve (the unit members 6, 7 and 8) shifts toward the piston 17 against the resilient force of the coil spring 9. When the shift distance of the intermediate member 2 toward the striking member 3 exceeds a predetermined amount, the first sleeve 7 constituting a part of the slide sleeve closes the ventilation holes 19 of the cylinder 4 (refer to FIG. 1A). Closing the ventilation holes 19 in this manner in response to the shifting movement of the intermediate member 2 toward the striking member 3 disconnects the air chamber 18 in the cylinder 4 from the outside of the cylinder 4. When the hammer drill is driven in this condition, a striking force transmitting mechanism (i.e., the members 14, 15, 16, 17, 18) operates in the ordinary manner to cause the striking member 3 to reciprocate in the axial direction in the cylinder 4. In response to the reciprocative motion of the striking member 3, the intermediate member 2 strikes the working tool 1.

When the user releases the depression or pushing force applied on the working tool 1 placed on the opponent member to be drilled during or after the striking operation, the intermediate member 2 shifts or returns toward the working tool 1 by the urging force of the coil spring 9 transmitted from the slide sleeve. The slide sleeve (7, 8, 6), always urged by the coil spring 9, follows the returning motion of the intermediate member 2. When the shift distance of the intermediate member 2 toward the working tool 1 exceeds a predetermined amount, the first sleeve 7 opens the ventilation holes 19 of the cylinder 4 (refer to FIG. 3). Opened ventilation holes 19 allow the air chamber 18 in the cylinder 4 to communicate with the outside of the cylinder 4.

When the hammer drill is driven in this condition, the striking force transmitting mechanism (i.e., the members 14, 15, 16, 17, 18) does not operate in the ordinary manner. The striking member 3 does not reciprocate in the axial direction in the cylinder 4. No striking force is transmitted from the striking member 3 to the working tool 1. Namely, the hammer drill is brought into an idle or inoperable condition.

According to the above-described arrangement of the hammer drill according to the preferred embodiment of the present invention, the slide sleeve (i.e., the members 6, 7 and 8) always follows the shifting movement of the intermediate member 2. Thus, the slide sleeve (i.e., the members 6, 7 and 8) has a function of detecting the operated condition (i.e., the axial position) of the working tool 1 which is depressed or pushed against an opponent member to be drilled for a striking operation. The slide sleeve (i.e., the members 6, 7 and 8) controls the communication between the air chamber 18 in the cylinder 4 and the outside of the cylinder 4. This surely prevents the striking member 3 from continuing the non-load striking motion.

The annular ring 6, constituting a part of the slide sleeve, has the inner cylindrical wall 6*a*. The inclined engaging portion 2*d* is formed on the outer cylindrical surface of the intermediate member 2 at its rear or proximal end closer to the striking member 3. The inner cylindrical wall 6*a* of the annular ring 6 is brought into contact with or engaged with the inclined engaging portion 2*d* of the intermediate member 2.

The intermediate member 2 has the large-diameter portion 2*a* which is positioned close to the working tool 1 and is held by the intermediate member holding bore 5*c* of the tool holder 5. The intermediate member 2 has a small-diameter portion 2*b* which is positioned close to the striking member 3. The inclined engaging portion 2*d* is formed at the rear or proximal end of the small-diameter portion 2*b* closer to the striking member 3 so as to be engaged with the inner cylindrical wall 6*a* of the annular ring 6.

In other words, the intermediate member 2 is surely held by the annular member 6 at its rear or proximal end very adjacent or close to the striking member 3. This arrangement surely prevents the intermediate member 2 from fluctuating in the radial direction at its rear or proximal end during the reciprocative movement of the intermediate member 2.

Holding both of the axial front and rear ends of the intermediate member 2 in this manner is effective to surely suppress the fluctuation of the intermediate member 2 in the radial direction. The intermediate member 2 does not incline with respect to the axes of the tool holder 5 and the cylinder 4. The striking force does not disperse toward the circumferential portions of the intermediate member 2. The striking force transmitting performance does not deteriorate. This assures the long-lasting life for the intermediate member 2 and the circumferential peripheral portions. This surely prevents the main body of the hammer drill from vibrating due to the striking force acting to the circumferential portions of the intermediate member 2.

The coil spring 9 resiliently urging the above-described slide sleeve (6, 7 and 8) toward the working tool 1 has a sufficient spring force for holding the slide sleeve (6, 7 and 8) at a position for maintaining the ventilation holes 19 in the opened condition even when the working tool 1 is held in the upright position where all the weight of the working tool 1 and the intermediate member 2 directly act in the downward direction against the coil spring 9.

Furthermore, according to the above-described embodiment, the inclined or tapered engaging portion 2*d* is formed on the outer cylindrical surface of the intermediate member 2 at its rear or proximal end closer to the striking member 3. The inner cylindrical wall 6*a* of the annular ring 6 is engaged with the inclined engaging portion 2*d* of the intermediate member 2. The radius of the inclined engaging portion 2*d* (i.e., a radius of a cross section of the engaging portion 2*d*) taken along a plane normal to the axis of the intermediate member 2 gradually decreases with axially approaching position toward the striking member 3. With this arrangement, the intermediate member 2 can be easily and accurately centered in the cylinder 4.

Figure 4:
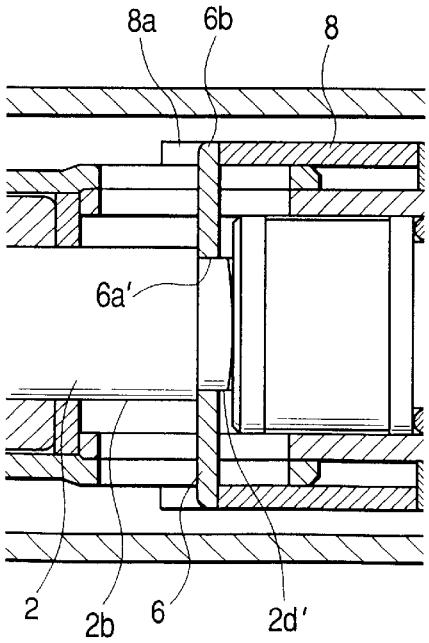
FIG. 4 is an enlarged cross-sectional view showing an essential portion of a hammer drill in accordance with another embodiment of the present invention.

FIG. 4 shows an essential portion of a hammer drill in accordance with another embodiment of the present invention.

According to the modified embodiment shown in FIG. 4, the rear or proximal end of the intermediate member 2 is configured into a cylindrical engaging portion 2*d*′ extending coaxially with the small-diameter portion 2*b* in the axial direction of the cylinder 4. The diameter of the cylindrical engaging portion 2*d*′ is smaller than that of the small-diameter portion 2*b*.

The annular member 6 has an inner cylindrical wall 6*a*′ which is configured into the shape brought into face-to-face contact with the cylindrical engaging portion 2*d*′ of the intermediate member 2. The shoulder portion between the small-diameter portion 2*b* and the cylindrical engaging portion 2*d*′ abuts the front flat surface of the annular member 6.

The resilient force of the coil spring 9 is transmitted via the first sleeve 7, the second sleeve 8, and the annular member 6 to the cylindrical engaging portion 2*d*′ of the intermediate member 2. The inner cylindrical wall 6*a*′ of the annular member 6 is brought into contact with the cylindrical engaging portion 2*d*′ of the intermediate member 2. Thus, the intermediate member 2 is always urged toward the working tool 1.

This arrangement is advantageous in that the axial width of the inner cylindrical wall 6*a*′ can be enlarged sufficiently. Thus, the annular member 6 is sufficient durable against the shock transmitted from the intermediate member 2 to the striking member 3.

Figure 5:
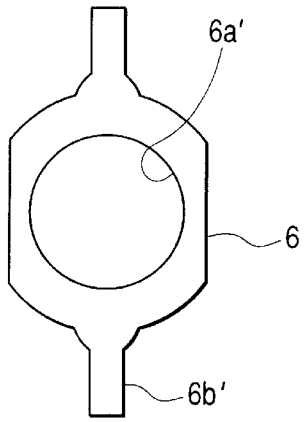
FIG. 5 is a front view showing another annular member constituting the hammer drill in accordance with the preferred embodiment of the present invention.

FIG. 5 shows another annular member constituting the hammer drill in accordance with the preferred embodiment of the present invention.

According to the modified annular member 6 shown in FIG. 5, each outwardly extending projection 6*b*′ is widened at the portion merging into the circular portion of the annular member 6. According to this arrangement, it becomes possible to improve the strength and the durability of the annular member 6 at the portion where the projection 6*b*′ merges into the circular portion, thereby assuring a long-lasting life of the annular member 6. The widened portion of the projection 6*b*′ is not limited to the straight shape and therefore can be formed into a curved shape.

Figure 6:
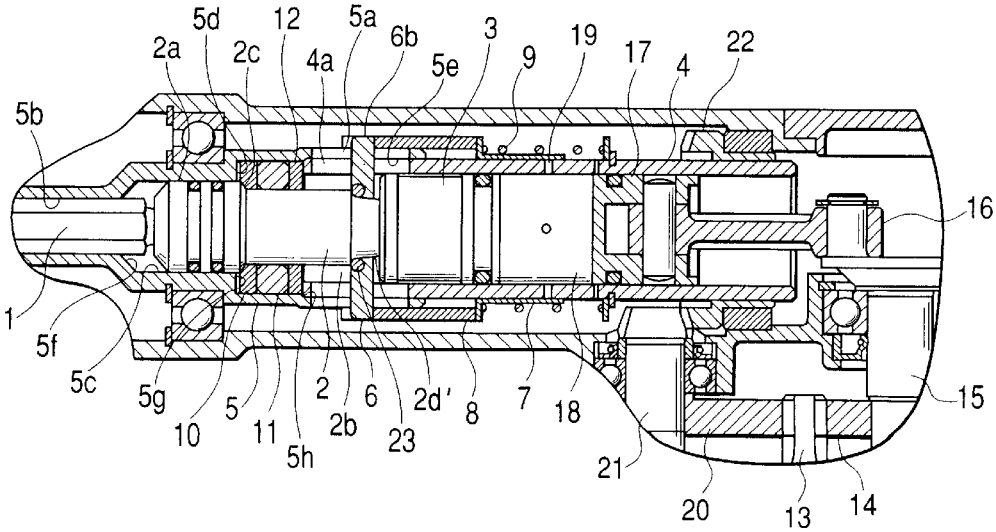
FIG. 6 is a vertical cross-sectional view showing a hammer drill in accordance with another embodiment of the present invention.

FIG. 6 shows a hammer drill in accordance with another embodiment of the present invention.

As shown in FIG. 6, the rear or proximal end of the intermediate member 2, closer to the striking member 3, is configured into the cylindrical engaging portion 2*d*′ extending coaxially with the small-diameter portion 2*b* in the axial direction of the cylinder 4. The diameter of the cylindrical engaging portion 2*d*′ is smaller than that of the small-diameter portion 2*b*. The shoulder portion is formed between the cylindrical engaging portion 2*d*′ and the small-diameter portion 2*b*.

The annular member 6 has the inner cylindrical wall 6*a*′ which is similar to that shown in FIG. 4 but is different in that the inner cylindrical wall 6*a*′ of this embodiment is partly configured into a stepped cylindrical wall having an inner diameter slightly larger than the diameter of the cylindrical engaging portion 2*d*′ of the intermediate member 2. The stepped cylindrical wall of the inner cylindrical wall 6*a*′ is located close to the shoulder portion so that a space for accommodating an annular cushion 23 is provided next to the shoulder of the intermediate member 2. Thus, the annular cushion 23 is provided between the engaging portion 2*d*′ of the intermediate member 2 and the annular member 6. The annular cushion 23, positioned around the cylindrical engaging portion 2*d*′ adjacent to the shoulder portion of the intermediate member 2, just fits into or abuts to the stepped cylindrical wall of the annular member 6.

According to this arrangement, the annular cushion 23 absorbs the shock transmitted from the intermediate member 2 to the striking member 3, thereby assuring a long-lasting life of the annular member 6.

As apparent from the foregoing description, according to the present invention, the intermediate member is surely supported at both of the axial front and rear ends thereof. Thus, it becomes possible to prevent the intermediate member from fluctuating in the radial direction. Accordingly, the present invention provides a hammer drill which is capable of surely preventing the striking member from continuing the non-load striking motion as well as capable of reducing the vibration and assuring a long-lasting life.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A hammer drill comprising:

a crank shaft driven by a motor;

a piston engaged with said crank shaft and slidably accommodated in a cylinder to reciprocate in an axial direction of said cylinder;

a striking member axially offset from said piston via an air chamber and slidably accommodated in said cylinder to reciprocate in the axial direction of said cylinder so that a reciprocative motion of said piston is transmitted via said air chamber to said striking member;

a tool holder disposed coaxially with said cylinder for detachably holding a working tool;

an intermediate member slidably accommodated in said tool holder or in said cylinder to reciprocate in the axial direction of said cylinder in response to a reciprocative motion of said striking member to strike said working tool;

a rotational motion transmitting mechanism for transmitting a rotational motion of said motor to said working tool, wherein said cylinder has a ventilation hole for allowing said air chamber to communicate with the outside, a slide sleeve is slidable in the axial direction of said cylinder and always urges said intermediate member in a direction opposed to said piston, so that said slide sleeve closes said ventilation hole when said intermediate member is positioned close to said piston while said slide sleeve opens said ventilation hole when said intermediate member is positioned far from said piston;

an engaging portion is formed at an axial end of said intermediate member and engageable with said slide sleeve;

said cylinder has an elongated hole with an axial length longer than a shifting distance of said intermediate member; and said slide sleeve comprises an annular member and a slide member, wherein said annular member has an inner cylindrical wall engageable with said engaging portion of said intermediate member and a projection extending in a radially outward direction passing through said elongated hole beyond an outer surface of said cylinder, and said slide member is coupled around the outer surface of said cylinder and slidable in the axial direction of said cylinder, with one axial end of said slide member positioned closer to said working tool being engaged with said projection of said annular member and the other axial end of said slide member being urged toward said working tool by an urging member.

2. The hammer drill in accordance with claim 1, wherein said intermediate member comprises a large-diameter portion which is positioned close to said working tool and a small-diameter portion which is positioned close to said striking member, a damper is disposed between said large-diameter portion of said intermediate member and said striking member to absorb an impact force to be transmitted from said intermediate member to said striking member, and said damper is interposed between a step formed on an inner wall of said tool holder and an axial end of said cylinder.

3. The hammer drill in accordance with claim 2, wherein a seal member is provided on an outer surface of said large-diameter portion of said intermediate member so as to be brought into contact with an inner wall of said tool holder.

4. The hammer drill in accordance with claim 1, wherein an annular cushion is provided between said engaging portion of said intermediate member and said slide sleeve.

* * * * *